US006726598B1

(12) United States Patent
Jarvis et al.

(10) Patent No.: US 6,726,598 B1
(45) Date of Patent: Apr. 27, 2004

(54) PULMONARY EXERCISE DEVICE

(75) Inventors: Barry M. F. Jarvis, Houston, TX (US); Carolyn E. Morse, Houston, TX (US)

(73) Assignee: Powerlung, Inc., Houston, TX (US)

( * ) Notice: Subject to any disclaimer, the term of this patent is extended or adjusted under 35 U.S.C. 154(b) by 28 days.

(21) Appl. No.: 10/018,122

(22) PCT Filed: Jun. 6, 2000

(86) PCT No.: PCT/GB00/02192

§ 371 (c)(1),
(2), (4) Date: Dec. 14, 2001

(87) PCT Pub. No.: WO00/78407

PCT Pub. Date: Dec. 28, 2000

(30) Foreign Application Priority Data

Jun. 18, 1999 (GB) ..... 9914138
May 3, 2000 (GB) ..... 0010536

(51) Int. Cl.[7] ..... A63B 28/13; A62B 7/00
(52) U.S. Cl. ..... 482/13; 128/200.24
(58) Field of Search ..... 482/13; 128/200.24, 128/202.16, 205.24, 269.12, 200.22

(56) References Cited

U.S. PATENT DOCUMENTS 4,054,134 A * 10/1977 Kritzer ..... 128/205.24
4,143,872 A 3/1979 Havstad et al.
4,284,083 A * 8/1981 Lester ..... 600/538
4,436,090 A * 3/1984 Darling ..... 128/204.26
4,466,433 A * 8/1984 Robbins ..... 128/202.22
4,487,207 A 12/1984 Fitz
4,739,987 A * 4/1988 Nicholson ..... 482/13
4,854,574 A * 8/1989 Larson et al. ..... 482/13
5,222,490 A * 6/1993 Pomerantz et al. .... 128/204.26
5,451,190 A * 9/1995 Liardet ..... 482/13
6,435,032 B1 * 8/2002 Holloway et al. ..... 73/713

FOREIGN PATENT DOCUMENTS

EP 0 997 168 3/2000
GB 2 278 545 7/1994

* cited by examiner

*Primary Examiner*—Nicholas D. Lucchesi
*Assistant Examiner*—Fenn C Mathew
(74) *Attorney, Agent, or Firm*—Harrison & Egbert

(57) ABSTRACT

A pulmonary exercise device includes a tubular body with an air inlet, an air outlet and a mouthpiece. The air inlet is closed by a one-way valve arrangement which is resiliently biased using a spring. The air outlet is closed by a one-way valve arrangement which is resiliently biased closed by using a spring. In another aspect, the inlet and outlet are closed off by respective one way valves which prevent airflow in one direction and allow only a restricted flow in the other.

3 Claims, 4 Drawing Sheets

PULMONARY EXERCISE DEVICE

FIELD OF THE INVENTION

The invention relates to a pulmonary exercise device for exercising and improving the lungs and the lung capacity of a user.

BACKGROUND OF THE INVENTION

Pulmonary exercise devices generally comprise a hollow tubular body with a mouthpiece at one end and an air inlet spaced from the mouthpiece. Between the mouthpiece and the air inlet a one way valve is provided which allows air to be exhaled freely whilst inhaled air must be drawn in against a spring bias of the valve. In that way, the pulmonary muscle system of the user is trained. The device can be used by itself or can be used in conjunction with other exercise, such as aerobic exercises so that the lungs are trained in concert with the cardiovascular system and the rest of the body.

BRIEF SUMMARY OF THE INVENTION

It is an object of the invention to provide an improved pulmonary exercise device.

In accordance with one aspect of the invention there is provided a pulmonary exercise device comprising a tubular body having an air inlet, an air outlet and a mouthpiece, the air inlet being closed by means of a resiliently biased one way valve and the air outlet being closed by means of resiliently biased one way valve.

In that way, the pulmonary system of the user is exercised against a resilient bias during inhalation and exhalation.

Preferably the resilient bias acting against the air flow in each of the air inlet and outlet is adjustable so as to enable the device to be tuned to the individual requirements of the user.

The resilient bias in the air inlet is preferably provided by means of a tension spring. The resilient bias in the air outlet is preferably provided by means of a compression spring.

The adjustment of the resilient bias is preferably provided by tightening the appropriate spring so as to provide increased or decreased initial tension/compression. Preferably, the adjustment of the spring is effected by screw threaded adjustment means.

Each spring is preferably removable. In that way the spring can be changed for a different grade of spring so as to change the working range of the device. Most preferably, the air inlet and air outlet may each employ one of three springs respectively, so as to provide light, medium or heavy duty exercise. Of course, it is possible to provide a lighter duty exercise spring, for example in the air inlet, and a heavier duty exercise spring in the air outlet and vice versa where appropriate.

The device preferably comprises a tubular body, the mouthpiece being arranged at one end of the tubular body, the air inlet being arranged at the other end of the tubular body and the air outlet being formed in the side of the tubular body.

The tubular body may be L-shaped and the mouthpiece may be formed in one end of the L-shape, the inlet may be formed in the other end of the L-shape and the outlet may be formed in a side wall of the L-shaped tube.

The device may be provided with straps to enable the device to be fitted to the head of the user so the device can be operated hands-free.

In accordance with another aspect of the invention there is provided a pulmonary exercise device comprising a tubular body having an air inlet, an air outlet and a mouthpiece, the air inlet being closed off by an inlet one way valve and the air outlet being closed off by an outlet one way valve, the inlet one way valve preventing airflow from the mouthpiece out of the device via the air inlet and allowing airflow via an inlet valve opening to the mouthpiece into the device, the outlet one way valve preventing airflow to the mouthpiece from the air outlet and allowing airflow via an outlet valve opening from the mouthpiece out of the device, the dimensions of the inlet valve opening and outlet valve opening being arranged to allow a restricted flow of air through the opening.

In that way the flow of air in and out of the device is restricted so that greater effort is required to breathe through the device.

Preferably, the inlet and/or outlet valve opening is/are adjustable to effect variable resistance to flow through the valves.

BRIEF DESCRIPTION OF THE SEVERAL VIEWS OF THE DRAWINGS

Embodiments of the invention will now be described in detail by way of example and with reference to the accompanying drawings.

DETAILED DESCRIPTION OF THE INVENTION

Figure 1:
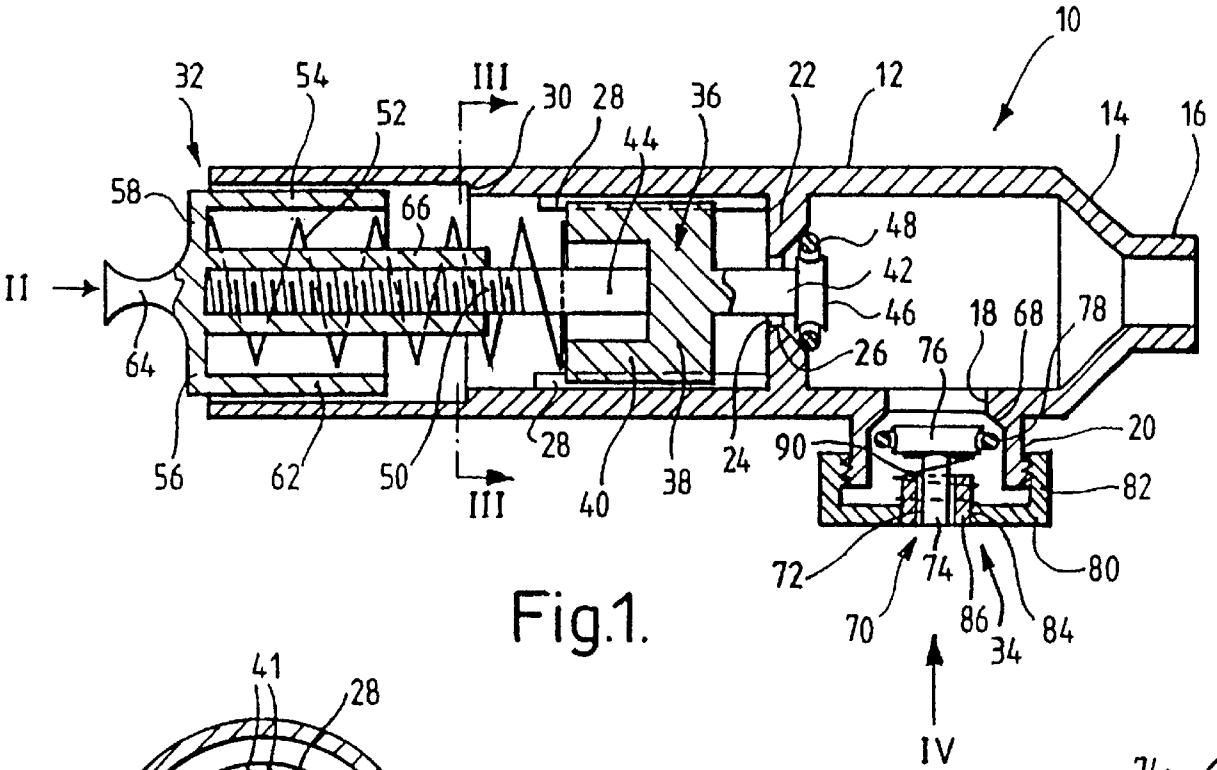
FIG. 1 is a cross-sectional view through a pulmonary exercise device in accordance with the invention.

In FIG. 1 a pulmonary exercise device 10 comprises an elongate hollow tubular body 12 open at both ends. At one end the tube tapers via a frustoconical shoulder 14 into a reduced diameter tube section 16 forming a mouthpiece of the tube. An aperture 18 is formed in a side wall of the tube 12 towards the mouthpiece end thereof. The aperture 18 is surrounded by a circular wall 20 which extends outwardly from the side wall of the tube 12.

Inside the hollow tubular body 12 an annular shoulder 22 defining an aperture 24 therethrough is formed in the wall of the tube inner body 12. The shoulder 22 has a chamfered inner edge 26 which acts as a valve seat. The inside wall of the tubular body 12 further includes two elongate guide tracks 28 which are diametrically opposed to each other. The guide tracks 28 extend from the face of the annular shoulder 22 facing away from the mouthpiece end 16 of the tubular body 12 towards the other end of the tubular body 12 spaced from the mouthpiece end 16 is widened for a distance down the tube. The inner diameter of the tubular body 12 is then reduced by means of a shoulder 30. The end of the tube spaced from the mouthpiece 16 comprises the air inlet 32 and the aperture 18 in the side wall of the tubular body 12 comprises the air outlet 34.

The air inlet 32 includes a valve arrangement indicated generally at 36.

Figure 3:
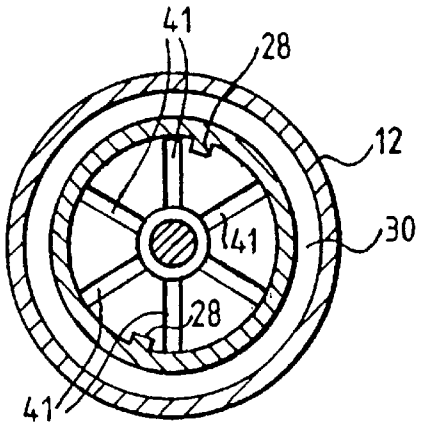
FIG. 3 is a cross-sectional view through device of FIG. 1 taken on line III—III in FIG. 1.

The valve arrangement 36 comprises a valve body 38 which is received slidably in the tubular body 12 on guide tracks 28. The valve body 38 comprises a main body section 40, a valve closure member 42 and an adjustment member 44. The main valve body section 40 includes apertures 41 to allow passage of air (see FIG. 3). The valve closure member 42 extends through the valve aperture 24 and has an enlarged valve closure head 46 surrounded by an O ring 48. The O ring 48 seals against the valve seat 26 formed by the chamfered edge of the annular shoulder 22. The adjustment member 44 comprises an elongate screw threaded shaft 50 which extends from the main body section 40 towards the air inlet end 32 centrally of the tubular body 12.

A tension spring 52 is attached to the main valve body section 40 and extends towards the air inlet end 32 of the tubular body 12. The tension spring 52 is secured at its other end to an adjustment device 54.

Figure 2:
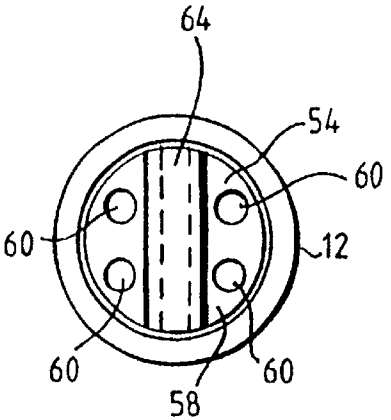
FIG. 2 is an end elevational view of the device of FIG. 1 looking in the direction of arrow II in FIG. 1.

The adjustment device 54 comprises a cup-shaped body 56 having circular base 58 with apertures 60 formed therein (see FIG. 2) and a circular peripheral wall 62 extending from the periphery of the base 58.

A handle 64 extends from the other side of the base 58 away from the peripheral wall 62. An internally screw threaded tube 66 extends from the base co-axially with the circular peripheral wall 62 towards the mouthpiece end of the tubular body 12. The adjustment member 50 of the valve body 38 is screw-threadedly received within the screw threaded tube 66. The spring 52 is secured to the base 58 of the adjustment mechanism 54.

The loading of the tension spring 52 on the valve 36 can be adjusted to make it easier or more difficult for the valve body 38 to be displaced by the inhalation of the user. If the user wishes the valve body to be relatively easy to displace then the adjustment member 54 can be screwed into the tube up to the point where the peripheral wall 62 of the adjustment mechanism abuts the shoulder 30 in the tubular body 12. That releases the tension in the tension spring 52 and allows the valve body 38 to move more readily so as to open the valve 36. As the user becomes fitter, the user will want to make inhalation more difficult and so the adjustment mechanism 54 can be screwed by means of the handle 64 away from the valve body 38 such that the tension spring 52 is loaded. In that way, when the user attempts to inhale through the device 10 the tension spring 52 resists movement of the valve body 38 and thus renders inhalation more difficult. That serves to exercise the pulmonary system of the user in inhalation.

The air outlet 34 comprises the aforesaid aperture 18 in the side wall of the tubular body 12 surrounded by the wall 20. Between the wall 20 and the aperture 18 a chamfered valve seat 68 is provided.

A valve assembly 70 is arranged within the annular wall 20. The valve assembly 70 comprises a valve body 72 having a shaft 74 and circular valve head 76. The valve head 76 is surrounded by an O ring 78 which abuts the valve seat 68 so as to seal the aperture 18.

Figure 4:
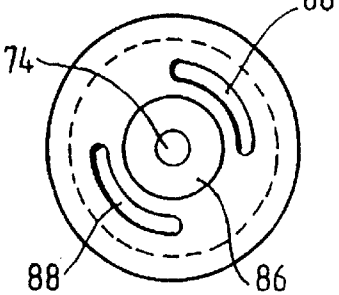
FIG. 4 is an elevational view of the air outlet part of the device of FIG. 1 looking in the direction of arrow IV in FIG. 1.

The wall 20 has an external screw thread and a cap 80 which has an annular wall 82 with an internal screw thread thereon is screw threadedly arranged on the wall 20. The cap 80 has an aperture 84 formed in the base thereof which receives a bush 86 surrounding the shaft 74 of the valve 72. Further air outlet apertures 88 (shown in FIG. 4) are provided in the base of the cap 80.

A compression spring 90 is arranged between the underside of the valve head 76 and the base of the cap 80 around the bush 86. The compression spring 90 biases the valve head 76 against the valve seat 68 so as to close the aperture 18. Screwing the cap 80 on to the annular wall 20 increases the compression on the spring 90 and thus renders opening of the valve 70 more difficult. Consequently, in order to render breathing out through the device simpler the cap 80 can be unscrewed from the wall 20. As the user improves, the cap 80 can be screwed on to the wall 20 until, ultimately, the cap is screwed fully on to the wall 20 and in that way the compression spring greatly resists movement of the valve head and thus exhalation through the device.

It should be noted that both the tension spring 52 in the air inlet and the compression spring 90 in the air outlet are replaceable with springs having different duties. In that way the operating range of the device is increased since an unfit user can begin with a very light duty spring and as the fitness of the user improves the loading on the spring can be adjusted until maximum loading has been achieved. At that point the spring can be removed and replaced with a heavier duty spring which will allow greater resistance exercise to be provided.

Figure 5:
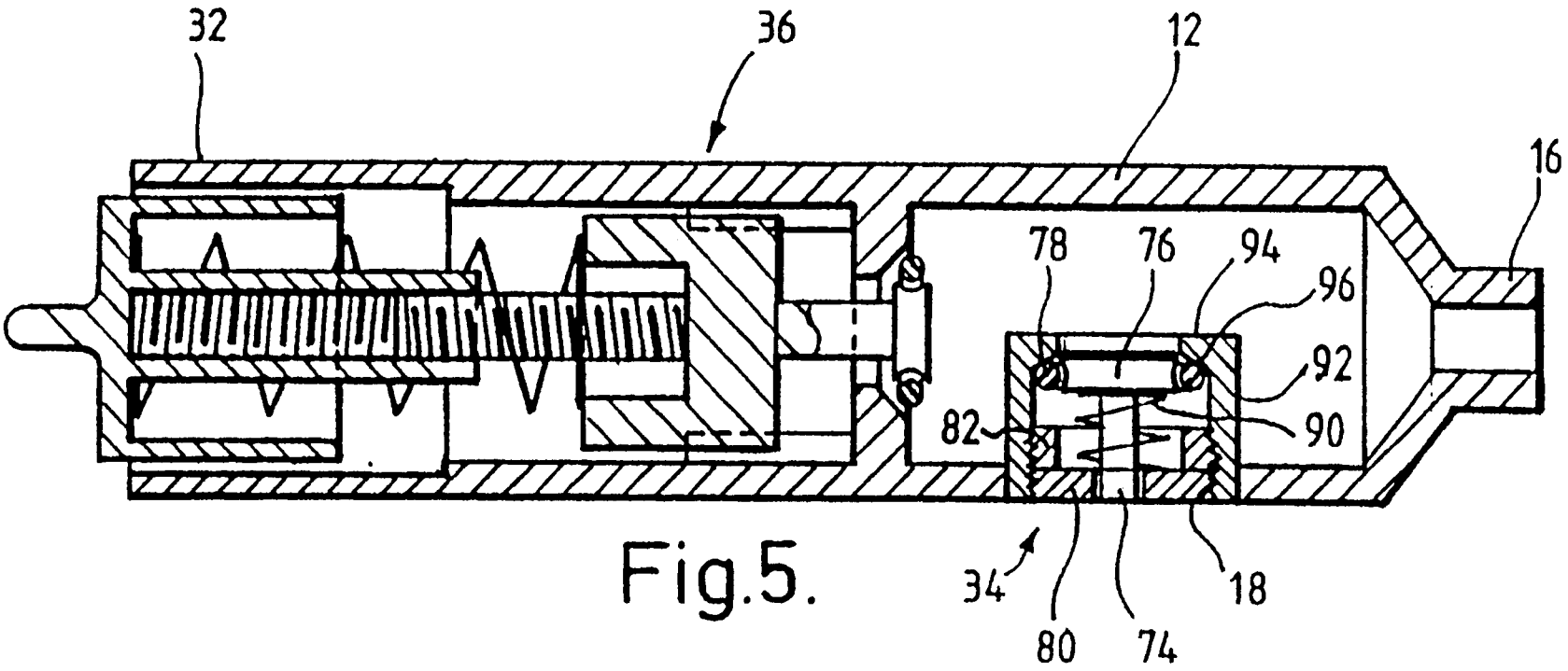
FIG. 5 is a cross-sectional view through another pulmonary exercise device in accordance with the invention.

In FIG. 5 an alternative pulmonary exercise device 10 is illustrated. Parts corresponding to parts in FIGS. 1 to 4 carry the same reference numerals.

The device 10 shown in FIG. 5 is similar in most respects to that shown in FIG. 1 and thus will not be described in detail. The principle difference between the device of FIG. 1 and that of FIG. 5 is that the air outlet is formed internally of the tubular body so that the external lines of the tubular body 12 are "uninterrupted". The air inlet arrangement of the device of FIG. 5 is identical to that described above.

In FIG. 5 the air outlet comprises an aperture 18 in the wall of the tubular body 12. An annular wall 92 surrounding the aperture 18 extends inwardly of the tubular body 12. The annular wall 92 includes an inwardly extending annular projection 94 having a chamfered edge 96 which acts as a valve seat. The annular wall 92 is internally threaded.

The valve 70 is substantially as shown in FIG. 1, having a shaft 74 and a circular valve head 76 with an O ring 78 surrounding the head 76. A compression spring 90 surrounds the shaft 74 and abuts the underside of the valve head 76. The other end of the compression spring 90 abuts a cap 80 which comprises a circular base and a peripheral wall 82. The peripheral wall 82 is externally screw-threaded and is dimensioned to be received within the annular wall 92. The cap is received in screw-threaded fashion. The base of the cap 80 has an aperture to receive the shaft 74 as a valve 70. The compression spring 90 abuts the base of the cap 80. As with the embodiment of FIG. 1, screwing the cap 80 out from the aperture lessens the load on the spring 90 and renders exhalation through the device easier. Tightening the cap 80 into the aperture increases the load on the spring 90 and renders exhalation more difficult.

Figure 6:
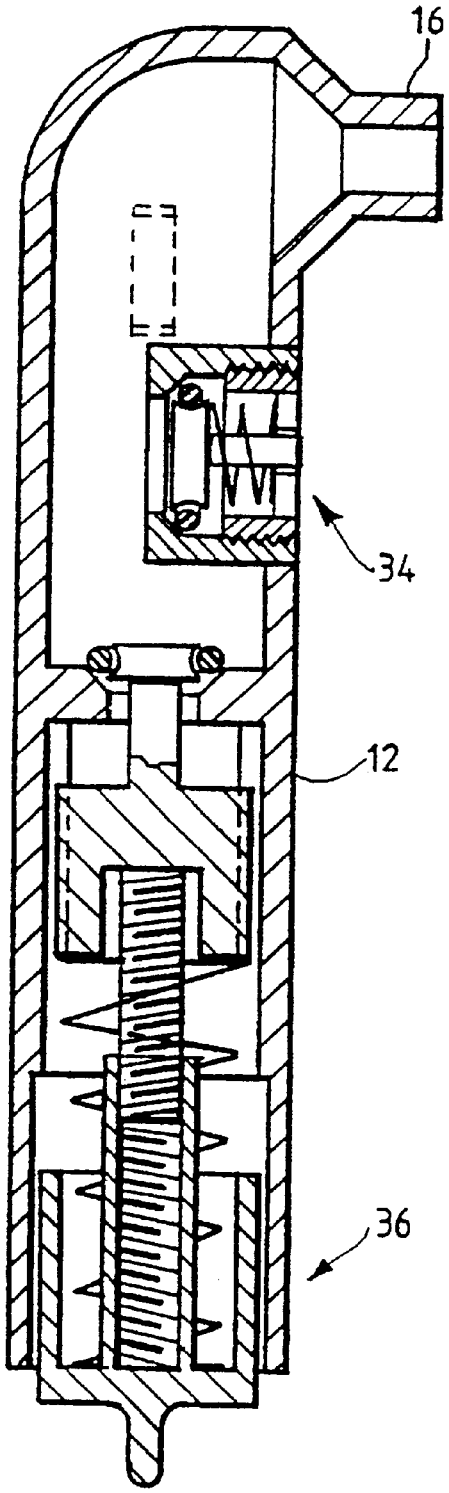
FIG. 6 is a cross-sectional view through a further pulmonary exercise device in accordance with the invention.
Figure 7:
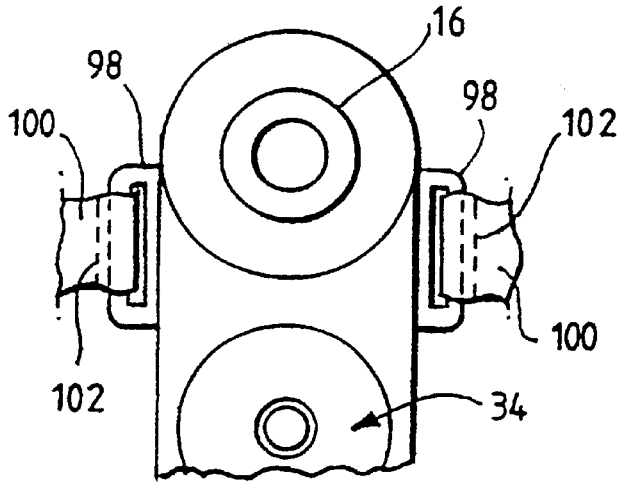
FIG. 7 is an elevational view of part of the pulmonary exercise device shown in FIG. 6 looking in the direction of arrow VII in FIG. 6.

The device of FIGS. 6 and 7 is substantially similar to that as shown in FIG. 5 and parts corresponding to parts in FIG. 5 carry the same reference numerals.

In FIG. 6 the device 10 is identical to that shown in FIG. 5 with the exception that the tubular body 12 is bent over at the mouthpiece end into an L-shape. Two loops 98 are formed, one each side of the tubular body 12 adjacent to the mouthpiece 16. The loops 98 receive respective ends of a strap 100 and the ends of the strap 100 are secured to the loops 98 by stitching 102. The strap 100 is preferably elasticated or includes an elasticated portion. In the embodiment shown in FIGS. 6 and 7 the pulmonary exercise device can be worn by the user by means of locating the strap 100 around the head and holding the mouthpiece 16 in the mouth so that the hands of the user are free during exercise. That is particularly advantageous where hands free operation is required, for example during cycling or rowing exercise.

Figure 8:
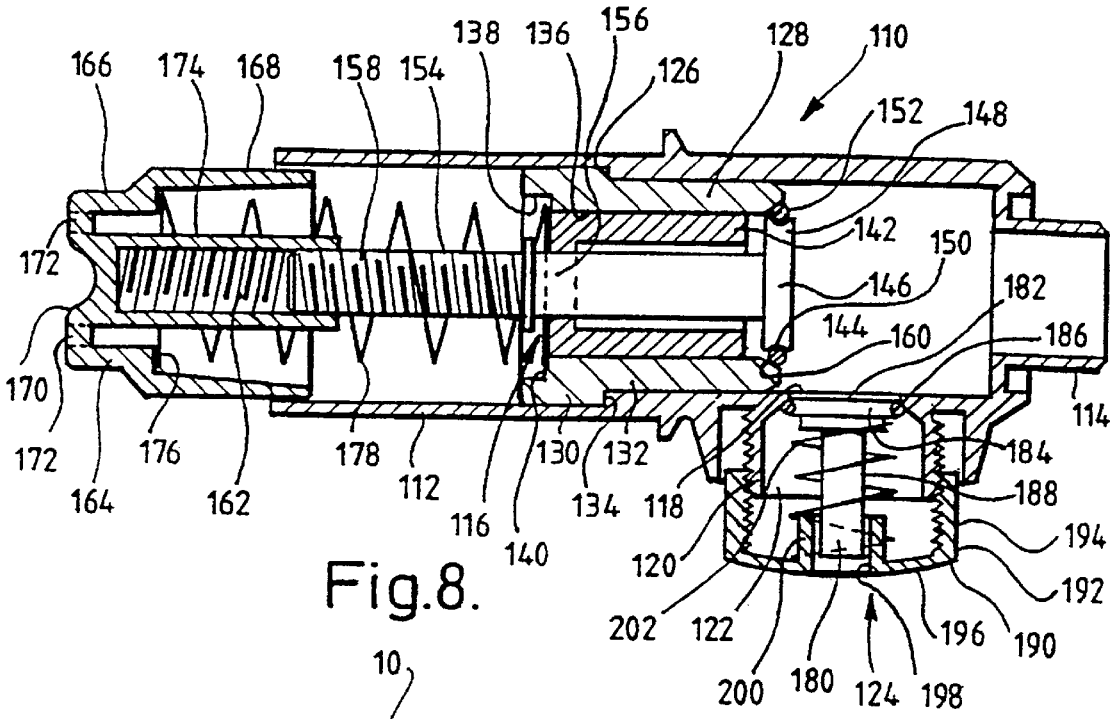
FIG. 8 is a cross-sectional view through an alternative form of pulmonary exercise device in accordance with the invention.

In FIG. 8 a pulmonary exercise device 110 is shown.

As with the device 10 of FIGS. 1 to 4, the pulmonary exercise device 110 comprises an elongate tubular body 112 open at both ends. One end of the body 112 defines a mouthpiece 114. The other end of the body 112 is closed off by an inlet valve assembly 116. An aperture 118 is formed in a side wall of the tubular body 112 adjacent the mouthpiece 114 end thereof. The aperture 118 is surrounded by a peripheral wall 120 defining a tube from the aperture 118 to another open end 122. The aperture 118 is closed off by an outlet valve assembly 124.

The inlet valve assembly 116 comprises an annular shoulder 126 formed on the inner periphery of the wall of the body 112. An annular collar 128 is arranged within the body 112. The collar 128 has a first outer wall portion 130 and a second outer wall portion 132 having a diameter smaller than the first outer wall portion 130. A step 134 is formed between the two outer wall portions. The step 134 abuts the annular shoulder 126. The collar 128 has a bore 136 formed therethrough, axially of the device 110. An enlarged diameter bore 138 is formed in the collar 128 at the inlet end of the device 110 so as to define a shoulder 140. A valve guide part 142 is formed integrally with the collar 128 within the bore 136.

The valve guide part 142 has an elliptical bore 144 formed therethrough axially of the device 110. A valve 146 is slidably received within the bore 144. The valve 146 comprises a circular valve head 148 having a peripheral channel 150 receiving an elastomeric O ring 152. The valve 146 further comprises an elongate stem 154 comprising a first part 156 extending from the valve head 146 through the bore 144 which is elliptical in cross-section. The dimension and shape of the stem part 156 and the bore 144 prevent the valve 146 from rotating. A second portion of the valve stem 154 extends from the end of the elliptical portion 156 away from the valve head 146. The second portion is circular in cross-section and has a screw-threaded periphery.

The valve head 148 seals by means of O ring 152 against a valve seat 160 defined by a chamfered portion of the collar 128.

The screw-threaded portion 158 of the stem 154 is screw-threadingly received in an internally screw-threaded bore 162 of an adjustment member 164. The adjustment member 164 comprises a cup-shaped body 166 having a cylindrical peripheral wall 168 and a substantially circular base 170. The base 170 has air inlet apertures 172 formed therethrough. A cylindrical projection 174 extends from the base 170 concentrically with the wall 168. The cylindrical projection 174 defines the aforesaid bore 162. An annular shoulder 176 is defined on the inside of the wall 168. A compression spring 178 is arranged between the shoulder 176 of the adjustment member 164 and the shoulder 140 on the collar 128. The spring 178 biases the adjustment member 164 away from the collar 128. Since the valve 146 is secured in screw-threaded fashion to the adjustment member 164, the action of the spring 178 holds the valve head 148 in sealing contact against the valve seat 160.

The adjustment member 164 can be used to adjust the force that is required to open the valve. In the figure the adjustment member is shown screwed away from the valve 146 so that only the tip of the screw-threaded portion 158 of the stem 154 of the valve 146 is received within the screw-threaded bore 162. In that position the compression spring 178 is virtually unloaded. Consequently, a low level of force is required to open the valve against the action of the spring. As the adjustment member 164 is screwed into the body so that more of the screw-threaded portion 158 of the stem 154 is received within the screw-threaded bore 162, the compression spring 178 is progressively loaded. A loaded spring requires more force to effect movement of the valve 146. Markings are provided on the outer peripheral wall of the adjustment member 164 to allow the user to adjust the device to the appropriate air inlet loading. Most preferably six levels of difficulty are indicated around the periphery of the adjustment member 164. Although six levels are indicated, the air inlet loading is, in fact, continuously variable between minimum and maximum levels. The six levels are provided as a guide to the user.

The outlet valve assembly 124 comprises a valve 180 comprising a circular valve head 182 having a peripheral channel 184 receiving an elastomeric O-ring 186. The valve 180 further comprises an elongate cylindrical stem 188 extending from the valve head 182. The valve head 182 seals against the peripheral wall surrounding the aperture 118. In particular, as can be seen in FIG. 8, the elastomeric ring 186 engages against chamfered parts of the walls surrounding the aperture 118. An outlet valve adjustment member 190 is provided. The outlet valve adjustment member 190 comprises a cup-shaped body 192 having a cylindrical peripheral wall 194 and a substantially circular base 196. A circular hole 198 is formed concentrically of the base 196. An upstanding circular wall 200 extends around the circular hole 198 within the body of the cup 192. The inner surface of the circular outer peripheral wall 194 is screw-threaded. The screw-thread on the inner surface of the wall 194 co-operates with a corresponding thread on the wall 120. A compression spring 202 extends between a surface of the valve head 182 and the inner surface of the base 196 of the cup-shaped member 192. The compression spring 202 acts against the base 196 to bias the valve head 182 into sealing engagement with the peripheral rim of the aperture 118.

Again, as with the inlet valve assembly 116, screwing the adjustment member 190 relative to the position of the aperture effects a change in the force required to open the valve.

In use, therefore, as with the embodiment shown in FIGS. 1–4, the user inserts the mouthpiece 114 into his mouth. The user then inhales air through the device 110. The drop in pressure adjacent the mouthpiece due to the inhalation of the user causes the outlet valve 180 to be further urged into sealing contact with the peripheral wall of the aperture 118. The negative pressure in the chamber adjacent the mouthpiece draws open the valve 146 of the inlet valve assembly 116 pulling the valve head 148 out of sealing contact with the valve seat 160 of the inlet valve assembly 116. Air can then pass through the apertures 172 and through the gap between the valve head and the valve seat to the user. During exhalation, the excess pressure adjacent the mouthpiece further pushes the inlet valve 146 closed against the valve seat 160. That pressure also pushes the outlet valve 180 away from the aperture 118 against the action of the spring 202 so as to open that valve. Apertures (not shown) similar to that provided in the base of the adjustment member 164 of the first valve assembly 116 are provided in the base 196 of the adjustment member 190 of the outlet valve assembly 124. The air escapes through the gap between the valve head 182 and the side of the aperture 118 and via the apertures formed in the base 196 of the adjustment member 190.

Regular use of the device 110 results in improvement in the lung capacity and lung muscle function of the user.

Alternatively to the above described embodiments, the valves may comprise simple one-way valves without resilient bias. In such a case, the inlet valve is arranged only to allow air flow in to the device to the mouthpiece and the outlet valve is only arranged to allow flow of exhaled air from the mouthpiece out of the device. The inlet valve, in such a case, is arranged with small inlet apertures which restrict inward air flow to a low level even though the valve is open. It is well within the ambit of the skilled person to select size of aperture appropriate to restrict the airflow sufficiently to provide exercise to the lungs of the user. A similar arrangement may apply in the outlet valve. In a preferred embodiment the size of the aperture through which air is allowed to flow in either the inlet or outlet means when the appropriate air flow direction pertains is adjustable by means of adjustment means. To that end, a dial or slider may be provided which allows progressive opening of multiple apertures or allows for more of a large aperture to be opened as the dial is turned or the slider is moved.

Figure 9:
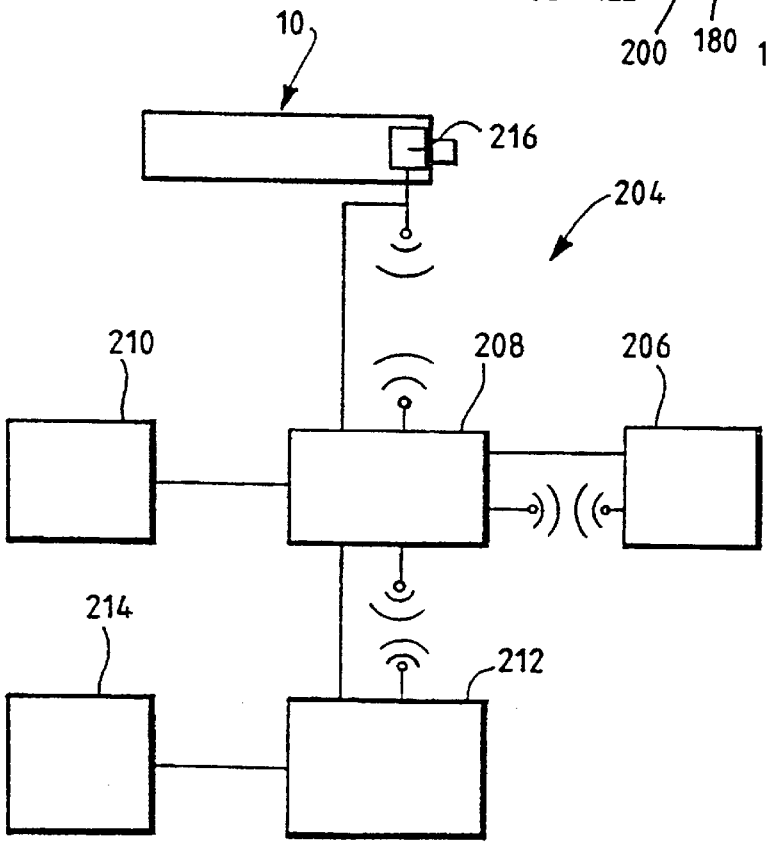
FIG. 9 is a schematic view of a pulmonary exercise device in an exercise system.

FIG. 9 shows a schematic view of an exercise device 10 in accordance with the invention forming part of an overall exercise system generally indicated at 204. The exercise system 204 comprises the pulmonary exercise device 10, an electrocardiograph machine 206, a local, preferably programmable, control unit 208, a local display 210, a remote control unit 212 and a remote display 214.

In the apparatus shown in FIG. 9, the pulmonary exercise device 10 includes a flow meter 216 preferably arranged between the valves and the mouthpiece to measure inhalation flow rate and volume and exhalation flow rate and volume. As shown in FIG. 9, the data from the flow meter 216 which is of known type is passed either by means of wiring or by wireless transmission, for example by infrared, radio frequency or ultrasound transmission to the local control unit 208.

An electrocardiograph machine 206 for measuring the heart rate and rhythm of the heart of the user is optionally provided. Again, the data from the electrocardiograph is passed either by wiring or by means of wireless transmission to the local control unit 208. The local control unit 208 preferably comprises a programmable chip. The data from the flow meter 216 and the electrocardiograph 206 is processed within the control unit 208 and pertinent results may be displayed to the user on a local display 210, such as an LCD display on a wristwatch or on a personal pager. Again, that data could be transferred either by wiring or by wireless transmission. That data may also optionally be transferred to a remote control unit 212. The remote control unit 212 is preferably a computer, such as a desktop personal computer. Again, that data can be transferred by direct hardwired data link or by wireless transmission. Alternatively, the data may be sent by electronic transmission, such as by e-mail. In such a case, the control unit 208 may form part of a mobile telecommunications apparatus with Internet access capability.

The data can then be processed by the remote control unit 212 and displayed on a remote display 214 such as a monitor for the personal computer.

The arrangement shown in FIG. 9 allows the user record his/her inhale and exhale air flow and lung volume, heart rate data and correlate the two. Preferably, the programmable chip may predict the user's inhale and exhale lung volume based on personal data including height, weight, age and desired or actual heart rate as measured by, the ECG machine. The predicted volumes may be compared against the actual volumes measured by the air flow meter 216. That data can also be sent to the remote control unit 212.

We claim:

1. A pulmonary exercise device comprising:

a tubular body having a reedless interior passageway;

a first one-way valve cooperative with said tubular body and communicating with said interior passageway, said first one-way valve movable between an open position and a closed position, said first one-way valve comprising:

a valve body slidably received within said interior passageway of said tubular body; and a valve seat formed in said interior passageway and interactive with said valve body, said valve body comprising:

a main body section; and a valve closure member extending from said main body section, said valve closure member being interactive with said valve seat;

a first urging means disposed against said first one-way valve for urging said first one-way valve to said closed position during an exhalation of a user;

a first adjusting means receiving said first urging means for adjusting a resistance of said first urging means against movement to said open position during an inhalation of the user, said first adjusting means having an exterior surface positioned exterior of said tubular body;

a second one-way valve disposed against said tubular body and communicating with said interior passageway, said second one-way valve moveable between an open position and a closed position;

a second urging means cooperative with said second one-way valve for urging said second one-way valve toward said closed position during an inhalation of the user;

a second adjusting means receiving said second urging means for adjusting a resistance of said second urging means against movement to said open position during an exhalation of the user, said second adjusting means having an exterior surface positioned exterior of said tubular body; and a mouthpiece connected to said tubular body and communicating with said interior passageway.

2. The device of claim 1, said first adjustment means comprising:

an adjustment member threadedly interconnected to said main body section, said first urging means being a spring having one end resiliently urging against said main body section and an opposite end resiliently urging against said adjustment member;

an elongate screw threaded shaft extending from said main body section; and a cup-shaped member extending outwardly of said tubular body, and cup-shaped member having an internally screw threaded tube, said tube receiving said shaft therein, said opposite end of said spring received within said cup-shaped member, said cup-shaped member having said exterior surface thereon positioned exterior of said tubular body.

3. The device of claim 1, said second one-way valve comprising:

an aperture formed in a wall of said tubular body; and a valve assembly resiliently interactive with said aperture, said valve assembly moveable away from said aperture during the exhalation by the user and covering said aperture during the inhalation by the user.

* * * * *